US006860403B1

(12) United States Patent
Mehrens et al.

(10) Patent No.: US 6,860,403 B1
(45) Date of Patent: Mar. 1, 2005

(54) SINGLE PILL DISPENSER

(76) Inventors: Doug Mehrens, 18 County Line Rd., Cerrillos, NM (US) 87101; David Smith, 12028 State Hwy. 14, North, Cedar Crest, NM (US) 87008

( * ) Notice: Subject to any disclaimer, the term of this patent is extended or adjusted under 35 U.S.C. 154(b) by 47 days.

(21) Appl. No.: 10/383,815

(22) Filed: Mar. 6, 2003

Related U.S. Application Data

(60) Provisional application No. 60/362,341, filed on Mar. 6, 2002.

(51) Int. Cl.[7] ..... B65G 59/00
(52) U.S. Cl. ..... 221/265; 221/288
(58) Field of Search ..... 221/265, 264, 221/263, 288, 266, 268, 246, 154, 262, 194; 222/370, 452, 519

(56) References Cited

U.S. PATENT DOCUMENTS 2,886,209 A * 5/1959 Lermer ..... 221/299
4,613,057 A * 9/1986 Sacchetti et al. ..... 221/265

* cited by examiner

*Primary Examiner*—Kenneth Noland
(74) *Attorney, Agent, or Firm*—Jeffrey D. Myers; Peacock Myers & Adams, P.C.

(57) ABSTRACT

A pill dispenser for a bottle (and corresponding method of dispensing a pill) comprising a cap with an interior chamber and a hole through a top of the cap and communicating with the interior chamber, which cap is rotatable when engaged with a corresponding bottle, and a pill stop oriented to dispense a single pill from the interior chamber through the hole when the bottle is oriented with cap downward and the cap rotated so that the hole and the pill stop correspond in position.

18 Claims, 7 Drawing Sheets

SINGLE PILL DISPENSER

CROSS-REFERENCE TO RELATED APPLICATIONS

This application claims the benefit of the filing of U.S. Provisional Patent Application Ser. No. 60/362,341, entitled "Construction Implements", filed on Mar. 6, 2002, and the specification thereof is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to pill bottles and apparatuses and methods for dispensing pills from pill bottles.

2. Description of Related Art

Every day, millions of people endure the laborious procedure of prying or twisting off a pill bottle cap; turning the bottle upside down; dumping too few or too many pills in their hand; repeating the procedure or returning extras to the bottle; and finally putting the cap back on. This process which is particularly difficult and painful for those with arthritic conditions or other motor difficulties, is then repeated later in the day and the next day, and the next. Accordingly, and apparatus and method is needed to eliminate this repetitious process and to dispense only the desired number of pills every time. The present invention provide this.

BRIEF SUMMARY OF THE INVENTION

The present invention is of a pill dispenser for a bottle (and corresponding method of dispensing a pill), comprising: a cap with an interior chamber and a hole through a top of the cap and communicating with the interior chamber, which cap is rotatable when engaged with a corresponding bottle; and a pill stop oriented to dispense a single pill from the interior chamber through the hole when the bottle is oriented with cap downward and the cap rotated so that the hole and the pill stop correspond in position. A dispensing ring with one or more holes communicating with the interior chamber of the cap is employed in one embodiment of the invention. A columnar portion may then be employed to direct pills from the bottle into the one or more holes of the dispensing ring when the bottle is oriented with cap downward. The columnar portion preferably comprises a conical portion at the end of the columnar portion opposite the end of the columnar portion engaging the dispensing ring. The columnar portion preferably comprises one or more vanes on the exterior of the columnar portion. Means for agitation of pills in the bottle are preferably employed, such as one or more paddles, cogs, or communicating tabs. The invention can dispense pills other than round pills.

The invention is also of a combination of a bottle and the pill dispenser described in the preceding paragraph. The bottle preferably comprises one or more bumps on the interior of the neck of the bottle.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of a pill dispenser apparatus and method comprising a bottle whose cap turns to dispense a single pill at a time into one's hand by inverting the bottle and turning the cap. Standard pill bottles can be retrofit with the invention or custom bottles can be manufactured. There is no cap to remove and child-proof mechanisms can be incorporated.

The majority of pills (about 90 percent of the market) are formed or pressed and come in two shapes (round or oval with convex front and back and flat or radial perimeters), and in one of five sizes (ranging from the very small, small, medium, or large of prescription drugs to the extra large size of some vitamins and related products). The present invention is equally effective for all of these sizes and shapes, not only for round pills. The invention can also be employed with other types of objects dispensed from bottles, such as hard or shelled candies of an appropriate shape.

Figure 1:
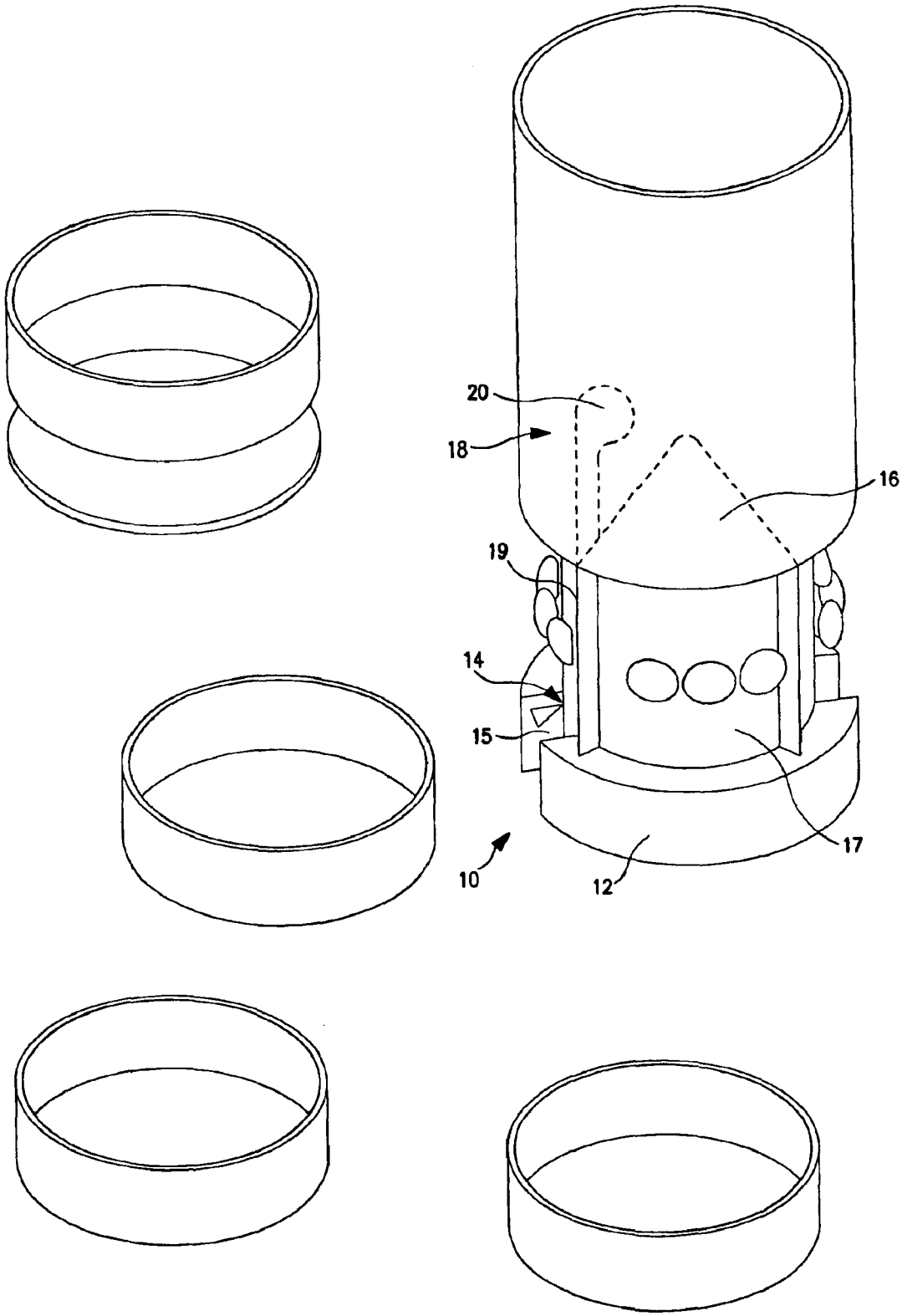
FIG. 1 is a bottom perspective view of a cap according to the invention used in conjunction with an existing pill bottle as partially disassembled.
Figure 2:
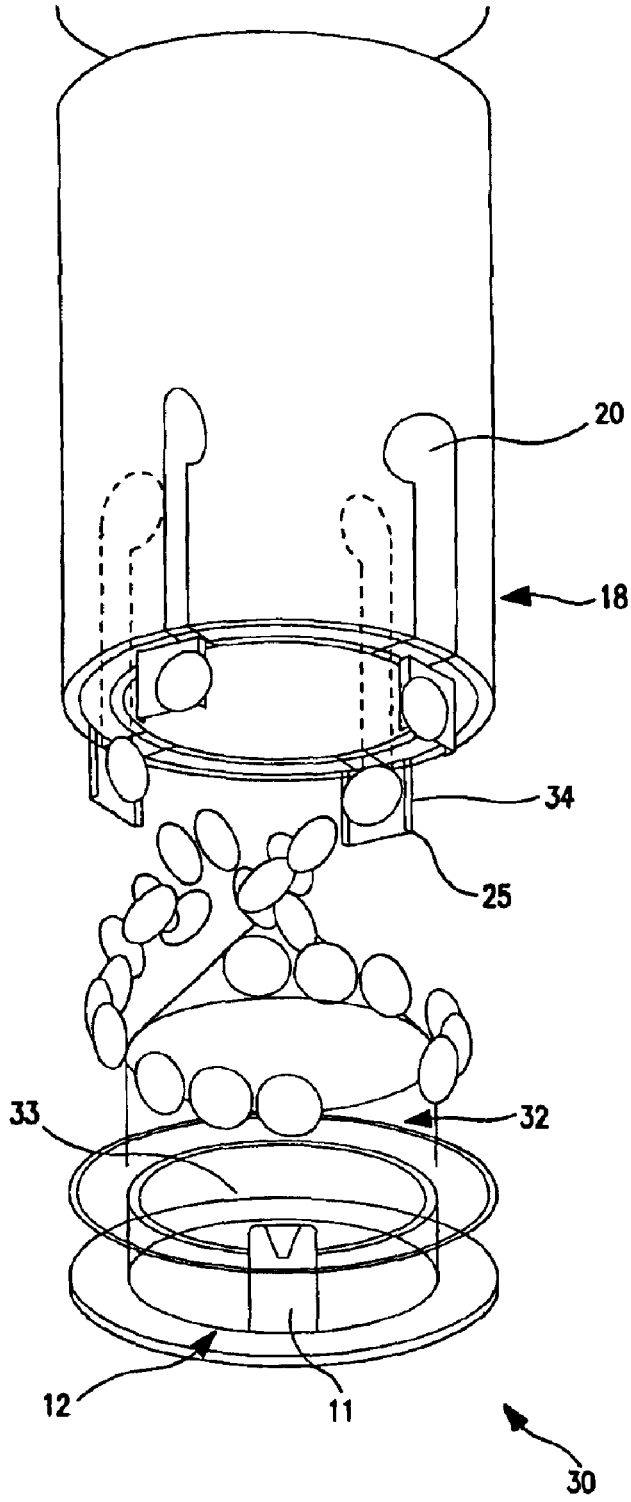
FIG. 2 is a bottom perspective view of a cap and dispensing ring according to the invention used in conjunction with an existing pill bottle as partially disassembled.

FIG. 1 shows a first embodiment 10 of a pill dispenser according to the invention used in conjunction with a bottle 18 (preferably slotted to firmly engage embodiment 10). Cap 12 (with hole 11 in top and interior pill stopper 33, as shown in FIG. 2) is attached to columnar portion 17 with a plurality of vanes 19, to which is attached cone 16 and optional agitator or agitators 20 (preferably paddles or cogs). When the bottle is inverted and the cap turned, pills drop into hole or holes 15 into the interior of the cap. As the cap is turned, when the interior pill stopper and the hole in the top of the cap are properly aligned, a single pill will be dispensed.

Agitators are used if desired to move, vibrate, and spin pills as the bottle and/or cap are moved so that pills do not get stuck in the device so as to clog or jam it.

FIG. 2 shows a second embodiment 30 of a pill dispenser according to the invention. A dispensing ring 34 is employed that snaps into the bottle. The ring comprises one or more protruding chambers 25 into which pills drop as the cap is turned.

Figure 3:
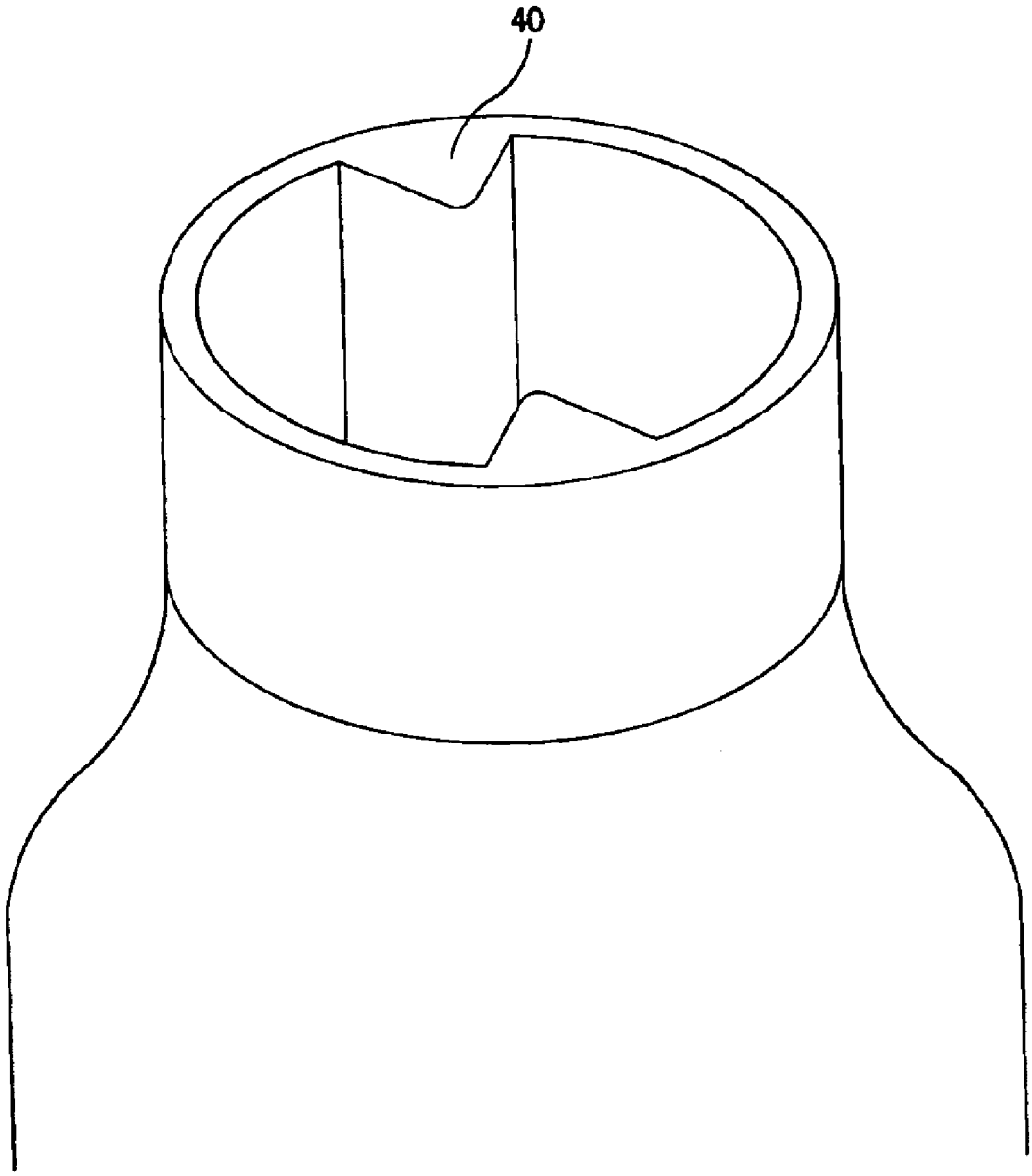
FIG. 3 is a top perspective view of a bottle modified to better direct pills into a pill dispenser according to the invention.
Figure 4A:
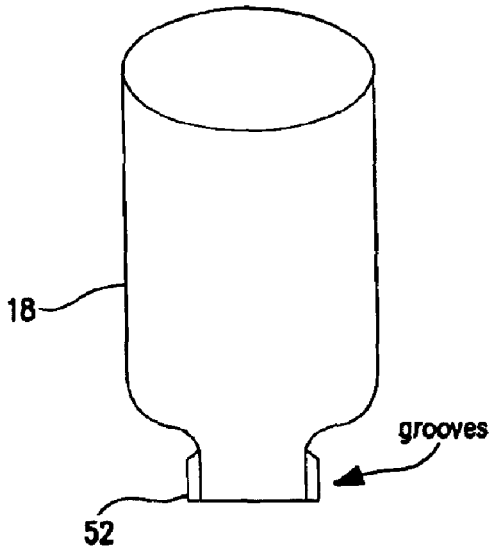
FIGS. 4(*a*)–(*d*) are views of a vibrating agitator assembly, respectively bottle side view, cap top view, cap side view, and bottle top view.
Figure 4B:
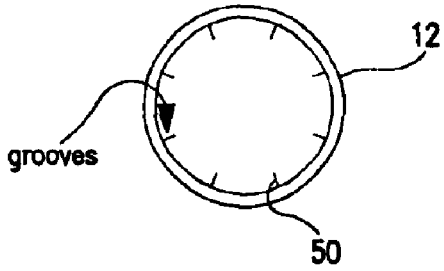
Figure 4D:
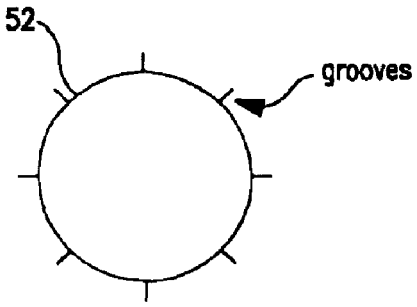
Figure 4C:
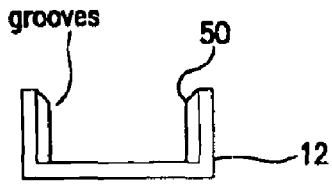

FIG. 3 shows a bottle modified to improve usefulness with respect to the present invention by incorporating a bump or bumps 40 into the neck portion of the bottle.

FIGS. 4(*a*)–(*d*) show a bottle and cap providing vibrating agitation via semi-flexible taps 50,52 that engage, click, and agitate the bottle as the cap or bottle are turned with respect to the other.

Figure 5A:
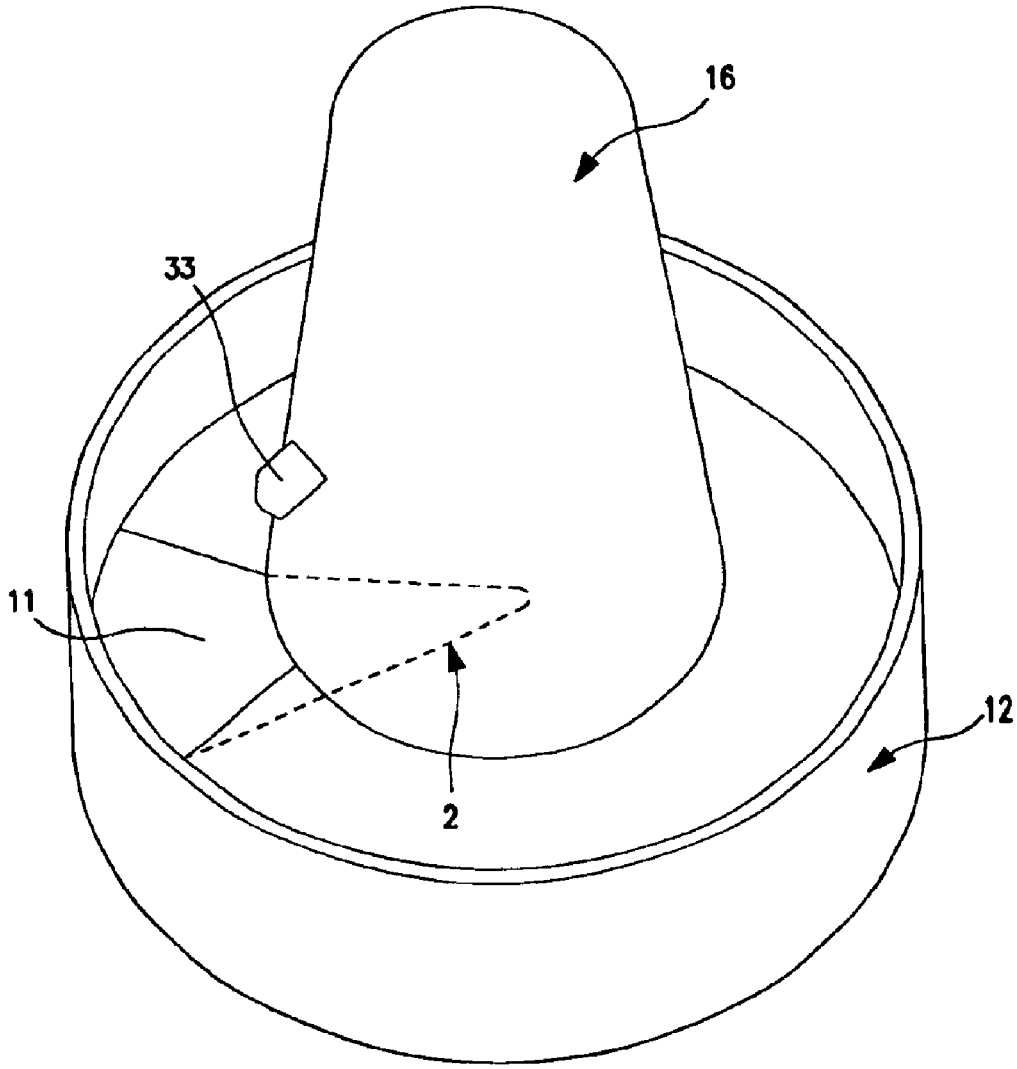
FIGS. 5(*a*)–(*b*) are perspective views of an embodiment of the invention not incorporating agitators, being a view of a simplified cap and the cap in conjunction with a bottle according to FIG. 3.
Figure 5B:
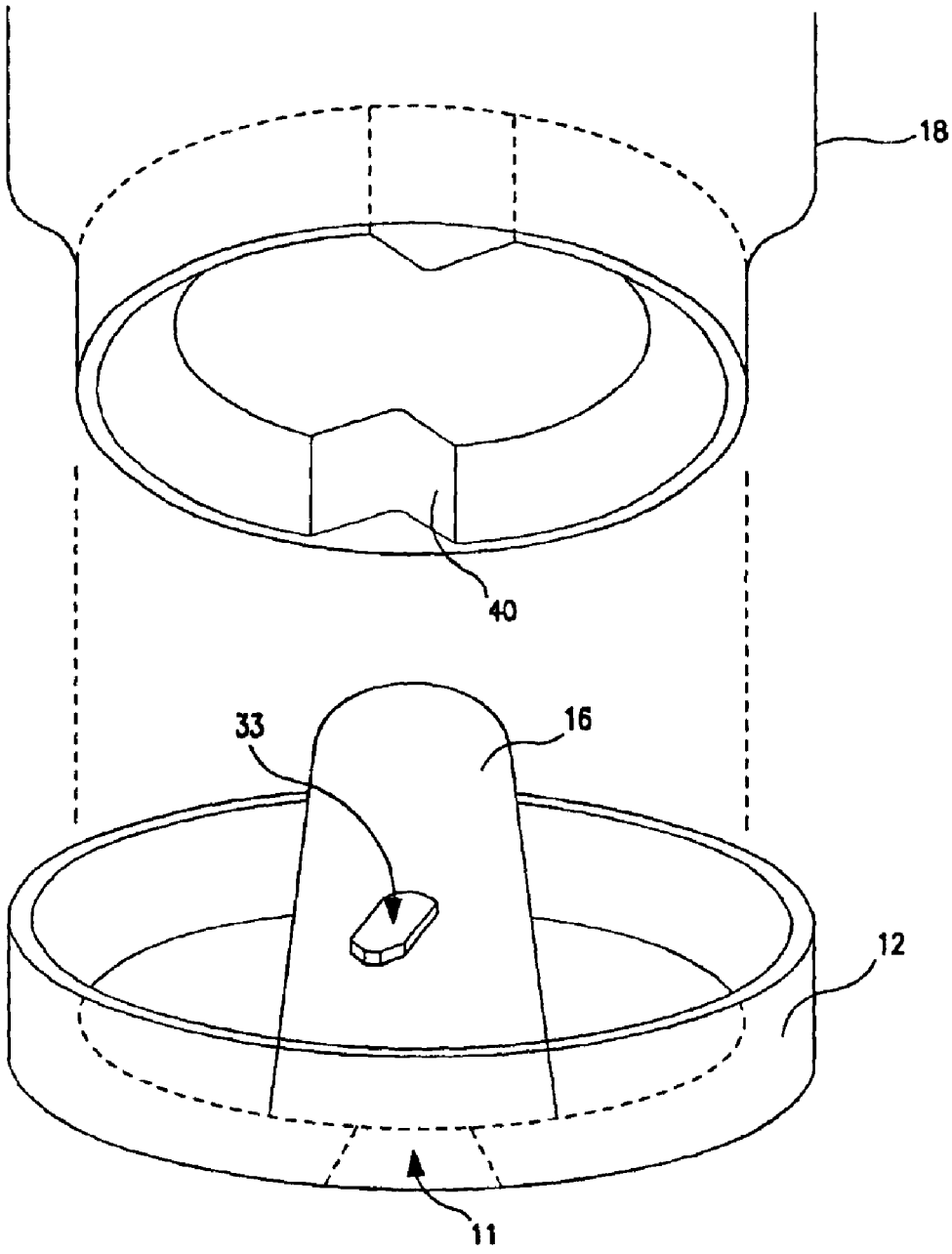

FIGS. 5(*a*)–(*b*) show an embodiment of the invention not incorporating agitators, being a view of a simplified cap and the cap in conjunction with a bottle according to FIG. 3. This embodiment is useful for pills having a shape (e.g., round) for which jamming is less of an issue.

Figure 6A:
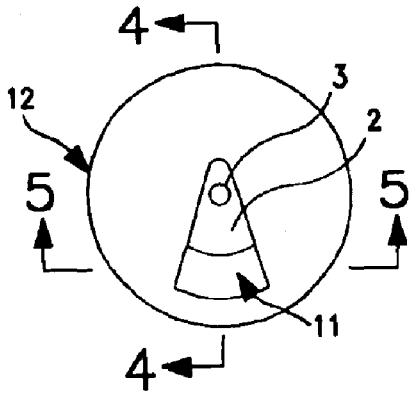
FIGS. 6(*a*)–(*c*) are top and section views of a child proof embodiment.
Figure 6B:
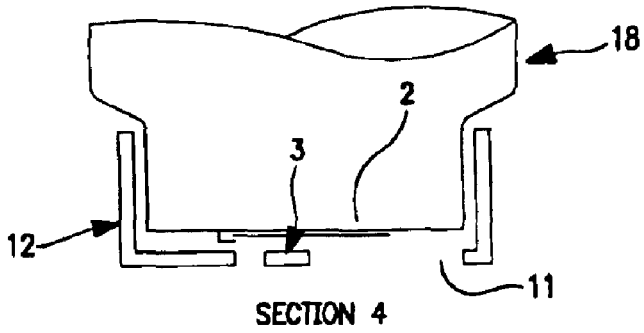
Figure 6C:
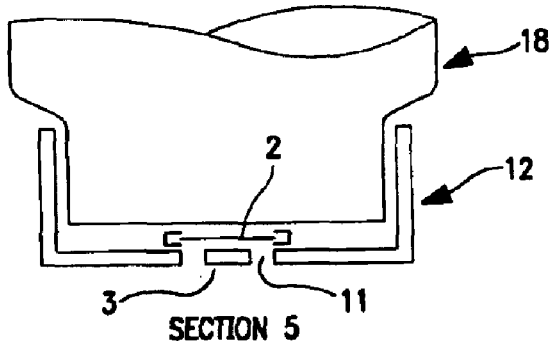

FIGS. 6(*a*)–(*c*) show a child-proof embodiment. Cap 12 comprises a slidable portion 2 with tab 3 for opening and closing hole 11. Sections 4 and 5 further illustrated the embodiment.

Additional child-proofing mechanisms can be added as understood by one of ordinary skill in the art. When used, these should be made readily manipulatable by those with arthritis or other conditions making manual manipulations of a bottle difficult and/or painful. One can also incorporate additional mechanisms to permit reinsertion of pills into the bottle, such as a slot or diaphragm that permits only ingress of pills. As understood by one of ordinary skill in the art, the precise shapes and sizes of the components of the invention must be altered depending on pill size and shape in order to effect best operation. The invention preferably includes a notch or tab that will make a clicking noise as a pill falls out.

The present invention provides an apparatus and method that: (1) is simple and durable; (2) provides precise dispensing without removal of the cap and with minimal effort; (3) is universally compatible with most pill sizes and shapes and existing types of pill bottles with no relocation of pills from the original bottle; (4) is inexpensive; and (5) is child proof.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A pill dispenser for a bottle, said pill dispenser comprising:

a cap with an interior chamber and a hole through a top of the cap and communicating with said interior chamber, which cap is rotatable when engaged with a corresponding bottle;

a dispensing ring with one or more holes communicating with said interior chamber of said cap; and a pill stop oriented to dispense a single pill from said interior chamber through said hole when the bottle is oriented with cap downward and said cap rotated so that said hole and said pill stop correspond in position.

2. The pill dispenser of claim 1 additionally comprising a columnar portion directing pills from the bottle into said one or more holes of said dispensing ring when the bottle is oriented with cap downward.

3. The pill dispenser of claim 2 wherein said columnar portion comprises a conical portion at an end of said columnar portion opposite an end of said columnar portion engaging said dispensing ring.

4. The pill dispenser of claim 2 wherein said columnar portion comprises one or more vanes on an exterior of said columnar portion.

5. The pill dispenser of claim 1 additionally comprising means for agitation of pills in the bottle.

6. The pill dispenser of claim 5 wherein said agitation means comprise one or more paddles, cogs, or communicating tabs.

7. The pill dispenser of claim 1 wherein pills other than round pills are dispensable.

8. A combination of a bottle and the pill dispenser of claim 1.

9. The combination of claim 8 wherein said bottle comprises one or more bumps on an interior of a neck of said bottle.

10. A method of producing a pill dispenser, the method comprising the steps of providing a pill bottle and combining the pill bottle with a pill dispenser according to claim 1.

11. The method of claim 10 wherein the providing stop comprises providing a bottle comprising one or more bumps on an interior of a neck of the bottle.

12. A method of dispensing a pill from a bottle, the method comprising the steps of:

employing a cap with an interior chamber and a hole through a top of the cap and communicating with the interior chamber, which cap is rotatable when engaged with a corresponding bottle;

employing a dispensing ring with one or more holes communicating with the interior chamber of the cap:

orienting the bottle with cap downward; and rotating the cap to cause a pill stop to dispense a single pill from the interior chamber through the hole.

13. The method of claim 12 additionally comprising employing a columnar portion directing pills from the bottle into the one or more holes of the dispensing ring when the bottle is oriented with cap downward.

14. The method of claim 13 wherein employing a columnar portion comprises employing a conical portion at an end of the columnar portion opposite an end of the columnar portion engaging the dispensing ring.

15. The method of claim 13 wherein employing columnar portion comprises employing one or more vanes on an exterior of the columnar portion.

16. The method of claim 12 additionally comprising employing means for agitation of pills in the bottle.

17. The method of claim 16 wherein employing agitation means comprises employing one or more paddles, cogs, or communicating tabs.

18. The method of claim 12 wherein pills other than round pills are dispensed.

* * * * *